US006928669B2

(12) United States Patent
Akin

(10) Patent No.: US 6,928,669 B2
(45) Date of Patent: Aug. 16, 2005

(54) CLOSET CARRIER SYSTEM AND METHOD OF ASSEMBLY

(75) Inventor: Craig R. Akin, Tyler, TX (US)

(73) Assignee: Tyler Pipe Company, Birmingham, AL (US)

( * ) Notice: Subject to any disclaimer, the term of this patent is extended or adjusted under 35 U.S.C. 154(b) by 0 days.

(21) Appl. No.: 10/339,985

(22) Filed: Jan. 10, 2003

(65) Prior Publication Data

US 2004/0133969 A1 Jul. 15, 2004

(51) Int. Cl.[7] ..... E03D 11/00; E03D 11/14

(52) U.S. Cl. ..... 4/252.2; 4/252.1; 4/252.4; 4/252.5

(58) Field of Search ..... 4/252.1, 252.2, 4/252.3, 252.4, 252.5, 252.6

(56) References Cited

U.S. PATENT DOCUMENTS

| | | | | | |
|---|---|---|---|---|---|
| 1,067,533 | A | * | 7/1913 | Mann et al. | 4/252.1 |
| 3,054,119 | A | * | 9/1962 | Manas et al. | 4/252.2 |
| 3,281,867 | A | * | 11/1966 | Pope | 4/252.1 |
| 3,406,409 | A | * | 10/1968 | Burns | 4/252.6 |
| 3,540,065 | A | * | 11/1970 | Gidner et al. | 4/420 |
| 3,855,649 | A | * | 12/1974 | Morris et al. | 4/252.1 |
| 4,423,526 | A | * | 1/1984 | Izzi, Sr. | 4/252.5 |
| 4,470,162 | A | | 9/1984 | Marshall | |
| 5,996,134 | A | * | 12/1999 | Senninger | 4/252.4 |
| 6,301,838 | B1 | | 10/2001 | Hall | |
| 6,327,717 | B1 | | 12/2001 | Johnson et al. | |
| 6,430,756 | B1 | * | 8/2002 | Reilly | 4/252.1 |

OTHER PUBLICATIONS

Brochure on Closet Carriers from Tyler Pipe/Wade Division, dated May 15, 2000.

* cited by examiner

*Primary Examiner*—Henry Bennett
*Assistant Examiner*—Amanda Wieker
(74) *Attorney, Agent, or Firm*—Jenkens Gilchrist, PC

(57) ABSTRACT

A closet carrier assembly has a carrier body assembly having at least one inlet for receiving waste and at least one outlet for communicating waste to a waste plumbing. The at least one inlet has internal threads and an outward facing surface substantially orthogonal to a longitudinal axis of the inlet. A tubular coupling is adapted to extend between the carrier body and the water closet. The tubular coupling has external threads thereon that threadingly engage the internal threads of the carrier body assembly and a flange member thereon that extends orthogonally to a longitudinal axis of the tubular coupling and resides adjacent the outward facing surface of the carrier body assembly. A deformable seal is compressed between the outward facing surface of the carrier body assembly and the flange member of the tubular coupling to form a water tight seal between the carrier body assembly and the tubular coupling.

37 Claims, 2 Drawing Sheets

Fig. 1
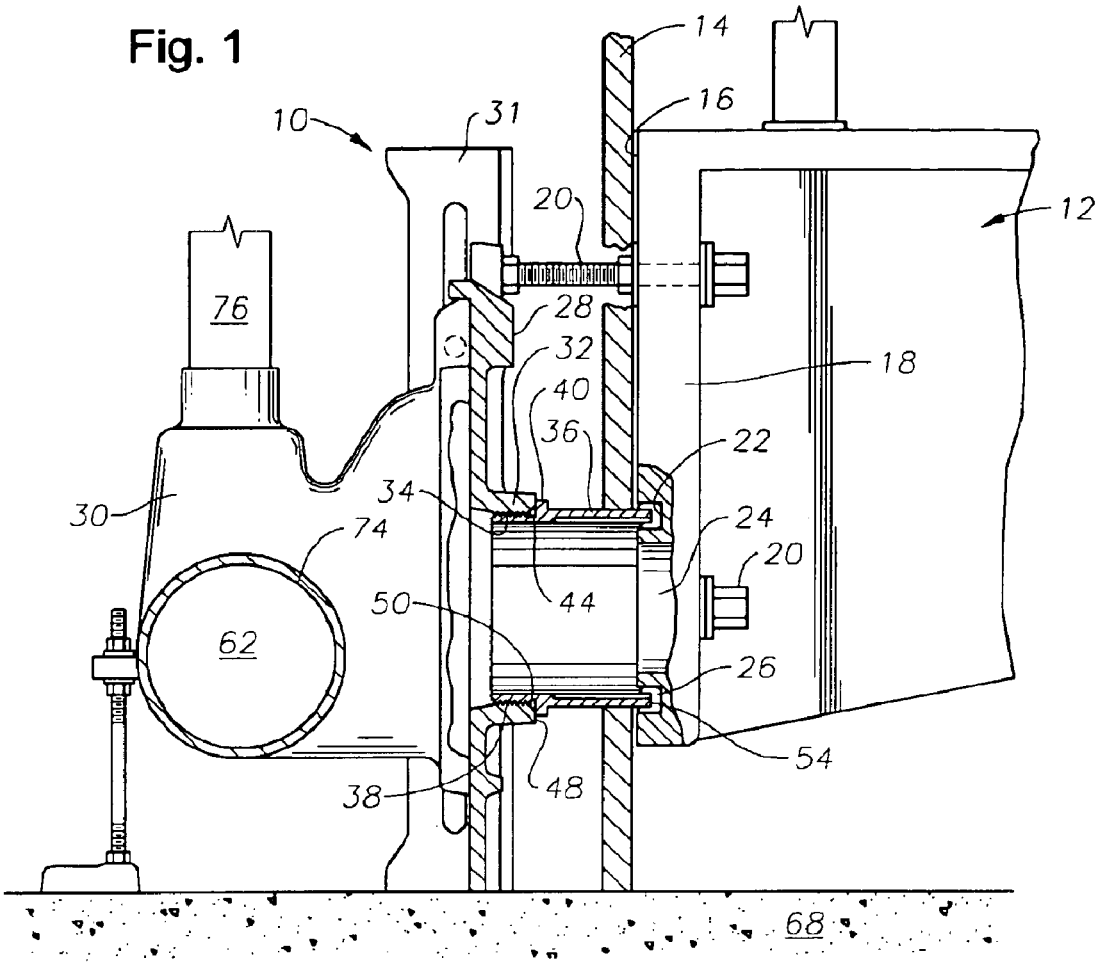
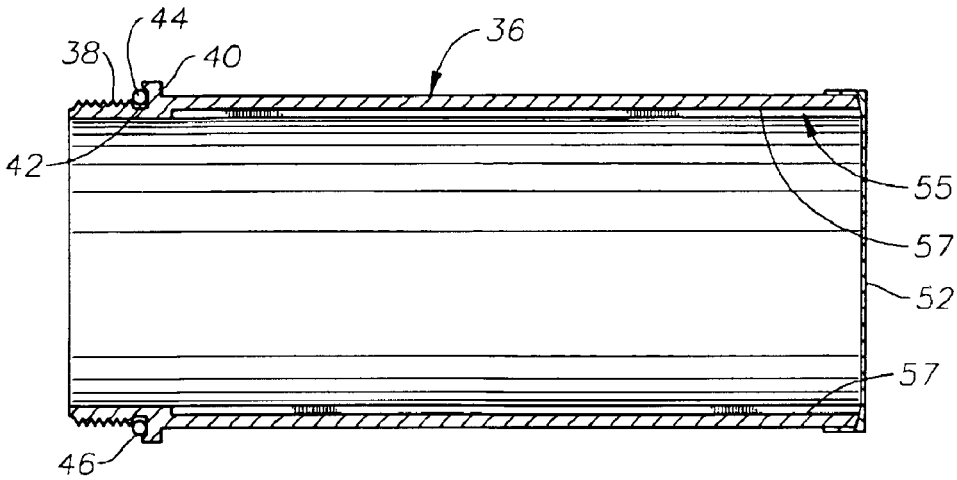
Fig. 3

CLOSET CARRIER SYSTEM AND METHOD OF ASSEMBLY

FIELD OF THE INVENTION

The invention relates to plumbing fixtures, and more particularly, to a system and method for mounting a water closet of the type in which waste is communicated through the rear of the water closet.

BACKGROUND

In a water closet installation where the waste is communicated through the rear of the water closet, the water closet is supported at least in part by a closet carrier assembly positioned behind the water closet. In addition to supporting the water closet, the closet carrier assembly connects the water closet to the on-site waste and vent plumbing. Due to factors such as differences in placement of the on-site pluming, desired placement of the water closet, and different configurations of water closets, the distance between the on-site plumbing and the water closet varies from installation to installation. The closet carrier assembly must include provisions to compensate for various distances between the water closet and on-site plumbing.

One common configuration of a closet carrier assembly includes a coupling that connects the water closet to the remainder of the closet carrier assembly. By varying the length of this coupling, a range of distances between the on-site plumbing and water closet can be accommodated. In some instances, the coupling is provided longer than is necessary, and cut to length after the closet carrier assembly is installed and leak tested.

In these prior art systems, the coupling joins and seals with the remainder of the closet carrier assembly by tapered pipe threads. It is undesirable to break the connection between the coupling and closet carrier assembly after the coupling has been assembled to the closet carrier and leak tested, because the seal made by tapered threads depends on achieving a consistent thread interference that can vary each time the threaded connection is taken apart and made-up. Furthermore, the exterior of the coupling is often obstructed and difficult to grasp with a wrench. Therefore, once the system is leak tested and the length of the coupling is determined, the installer cuts the coupling to length with the coupling installed on the remainder of the closet carrier assembly. Many times the installation surroundings, for example adjacent water closet installations, other plumbing installations, and walls, interfere with the ability of the installer to cut the coupling to length, thus making the installation more difficult and time consuming.

For the forgoing reasons, there is a need for an improved closet carrier assembly that addresses the issues of access to the coupling to therefore make installation easier.

SUMMARY

The present invention is directed to a closet carrier assembly for use with a water closet that communicates waste through a lateral port. The closet carrier assembly includes a carrier body assembly having at least one inlet for receiving waste and at least one outlet for communicating waste to a waste plumbing. The at least one inlet has internal threads and an outward facing surface substantially orthogonal to a longitudinal axis of the inlet. A tubular coupling is adapted to extend between the carrier body and the water closet. The tubular coupling has external threads thereon that threadingly engage the internal threads of the carrier body assembly and a flange member thereon that extends orthogonally to a longitudinal axis of the tubular coupling. The flange member resides adjacent the outward facing surface of the carrier body assembly. A deformable seal is compressed between the outward facing surface of the carrier body assembly and the flange member of the tubular coupling to form a water tight seal between the carrier body assembly and the tubular coupling.

The invention is also drawn to a method of installing a water closet that communicates waste through a lateral port to a closet carrier assembly. The method includes threadingly connecting a tubular coupling to a carrier body assembly of the closet carrier assembly. A length of the tubular coupling is determined such that the tubular coupling will connect to the lateral port of the water closet when the water closet is in an installed position. The coupling is threadingly disconnected from the carrier body assembly and cut to the determined length. The tubular coupling is threadingly re-connected to the carrier body assembly, and the water closet is attached to the closet carrier assembly such that the coupling connects to the water closet.

BRIEF DESCRIPTION OF THE DRAWINGS

These and other features, aspects, and advantages of the present invention will be better understood with reference to the following description, claims, and drawings where:

FIG. 1 is a side view of a closet carrier assembly constructed in accordance with the invention depicted supporting a water closet in relation to a wall; FIG. 3 is a cross sectional view of a closet coupling constructed in accordance with the invention.

DETAILED DESCRIPTION OF THE EXEMPLARY EMBODIMENTS OF THE INVENTION

Figure 2:
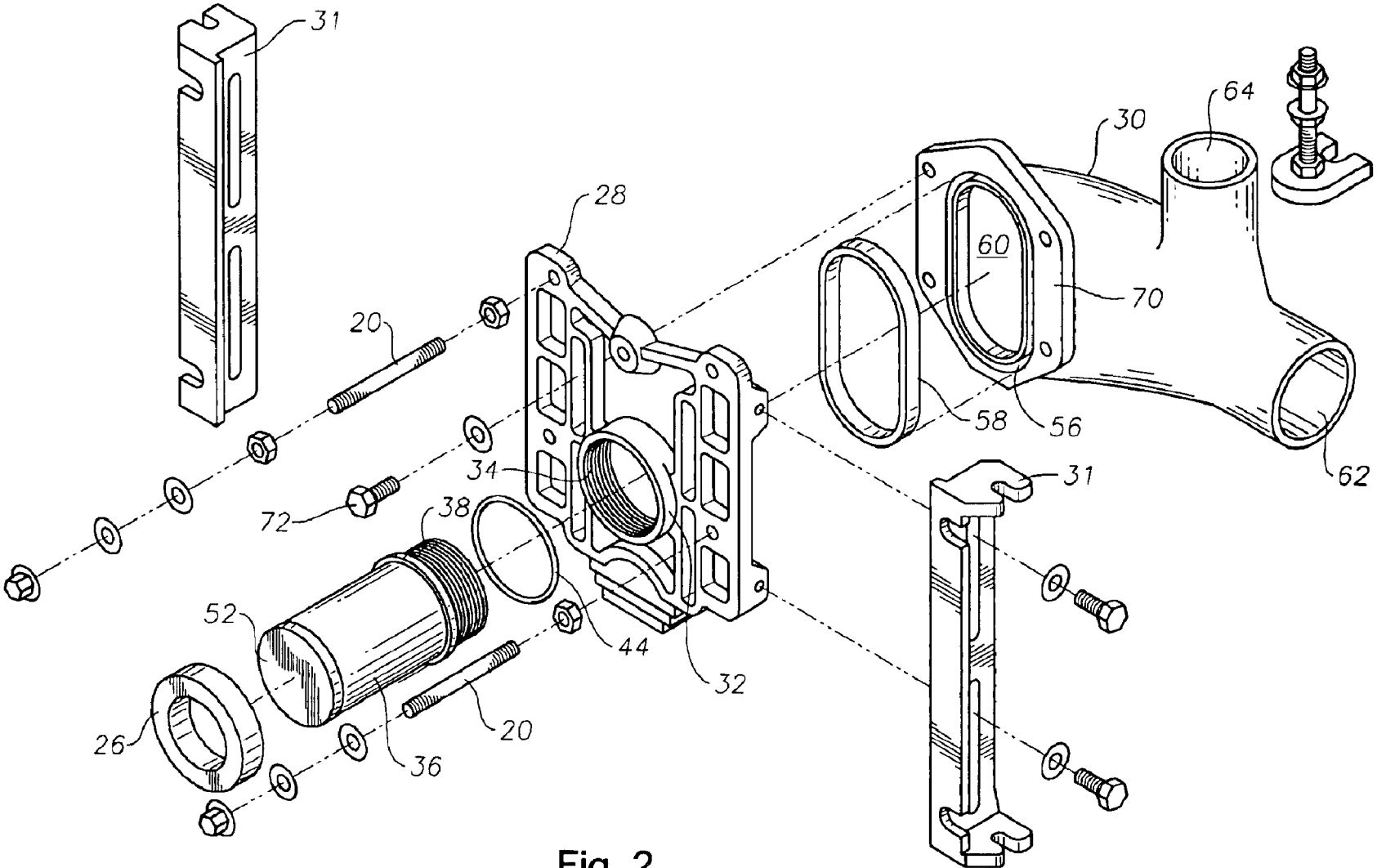
FIG. 2 is an exploded view of a closet carrier assembly constructed in accordance with the invention.

Referring first to FIG. 1, an exemplary closet carrier assembly 10 constructed in accordance with the invention is depicted supporting a water closet 12 in relation to a vertical wall 14.

The water closet 12 has a substantially planar end surface 16 that is adapted to abut or closely adjoin the vertical wall 14. Flange members 18 reside at opposing ends of the planar end surface 16, and are adapted to receive fasteners 20. Fasteners 20 extend outwardly from the closet carrier assembly 10, through the vertical wall 14, and engage the flange members 18 to thereby at least partially support the water closet 12. The water closet 12 has a sealing groove 22 in the end surface 16. The sealing groove 22 concentrically surrounds a laterally oriented flow port 24. The flow port 24 communicates water and waste between the bowl (not specifically shown) of the water closet 12 and the closet carrier assembly 10. Sealing groove 22 receives a deformable seal 26, for example a wax o-ring, that seals the water closet 12 to a coupling 36 of the closet carrier assembly 10 as will be described in more detail below.

Referring now to FIGS. 1 and 2, the closet carrier assembly 10 includes a faceplate 28 that joins to a carrier body 30. Although the faceplate 28 may have various indentations and voids, it is overall generally planar, and is installed in substantially parallel relation to the vertical wall 14. The fasteners 20 affix to faceplate 28 and extend orthogonally outward therefrom. It is important to note that, although the embodiment depicted in FIG. 2 would normally receive four fasteners, two of the fasteners have been omitted to more clearly depict other features of the invention. The faceplate 28 is carried by supports 31 that affix thereto, and are adapted for attachment to a fixed object such as the floor 68 or the vertical wall 14. The attachment point of the supports 31 can be adjustable to compensate for various distances between the faceplate 28 and the fixed object.

A cylindrical protrusion 32 extends outwardly from the plane of the faceplate 28 towards the vertical wall 14, and receives an elongate tubular coupling 36. The cylindrical protrusion 32 is affixed to or formed into the faceplate 28. The cylindrical protrusion 32 has internal threads 34 which threadingly receive external threads 38 on an end of coupling 36. The coupling 36 has a flange member 40 that resides adjacent to the external threads 38 and protrudes radially outward from the profile of the coupling 36. The flange member 40 is affixed to, or formed into, the body of the coupling 36. The depth of threads between the flange member 40 and the end of the coupling 36 is sufficient to support the coupling 36 when loaded with the water closet 12 and additional loads, for example the water closet's user.

It is important to note that, although depicted as such in the Figures, the flange member 40 need not be a discrete component. Rather, the flange member 40 can be virtually any surface that is substantially orthogonal to the longitudinal axis of the coupling 36. For example, the outer diameter of the coupling 36 can be greater than the major diameter of the external threads 38, and the transition between the two diameters can form the flange member 40.

The flange member 40 has a seal receiving groove 42 (shown in FIG. 3) thereon that together with the outer surface of the coupling 36, receives and positions a deformable seal 44. The material and configuration of the deformable seal 44 can be selected based on the specific installation to readily form a seal between the coupling 36 and cylindrical protrusion 32 by merely tightening the coupling 36 hand tight. The deformable seal 44 can be, for example, an o-ring, planar gasket or other similar seal. Furthermore, the seal 44 can be constructed from elastomeric material, cork, wax, or other similar deformable material. In an exemplary embodiment, the seal 44 is an elastomeric o-ring. The seal groove 42 is recessed into the flange member 40, and its outer diameter 46 is radiused to laterally retain the seal 44. When coupling 36 is fully received in cylindrical protrusion 32, flange member 40 is closely adjacent to an outward facing surface 48 of cylindrical protrusion 32. The seal 44 is thereby compressed between the cylindrical protrusion 32 and the flange member 40 to form a water tight seal between coupling 36 and faceplate 28. The outward facing surface 48 of the cylindrical protrusion 32 can have a seal groove 50 therein, corresponding to the seal groove 42 in the flange member 40. In such exemplary embodiment, the seal 44 is compressed and seals between the seal groove 42 and corresponding the seal groove 50 when the flange member 40 is tightened against the outward facing surface 48 of the cylindrical protrusion 32.

Although internal threads 34 of cylindrical protrusion 32 and external threads 38 of coupling 36 can be a sealing, tapered thread pattern (i.e. having a decreasing major diameter), for example a thread pattern conforming to the National Pipe Thread standard, such a thread pattern is not necessary, because the seal between the coupling 36 and cylindrical protrusion 32 is achieved with the deformable seal. Therefore, in one exemplary embodiment, internal threads 34 and external threads 38 are a straight (i.e. having a constant major diameter), non-tapered thread pattern, for example a thread pattern conforming to the Unified National standard (UNF or UNC) or the International Standards Organization (ISO) standard. Alternately, the threads can be reversed, where the coupling 36 has internal threads and the cylindrical protrusion 32 has external threads. Furthermore, the coupling 36 and cylindrical protrusion 32 can be joined using other methods than threads, such as a J-lock connection including a protrusion on one of the coupling 36 or cylindrical protrusion 32 that rides in a J-shaped or L-shaped groove on the other. Regardless of how the coupling 36 and cylindrical protrusion 32 are joined, the seal is formed by the deformable seal 44 and not by the threads; therefore, no sealing compound is needed to be applied to the threads as would be necessary if the threads make the water tight seal.

A tool engaging profile 55 can be provided on the coupling 36 that enables the coupling 36 to be engaged through the open end 54 and rotated with a tool. Though it is within the scope of this invention to provide the tool engaging profile 55 on the exterior of the coupling 36, in the exemplary embodiment of FIG. 3, the tool engaging profile 55 is provided in the interior of the coupling 36. Such a tool engaging profile 55 is especially useful where the exterior surface of coupling 36 is obstructed such that it is difficult or not possible to grasp the exterior of the coupling with a wrench. For example, if the water closet 12 is installed in relation to a vertical wall 14 as in FIG. 1, the portion of the coupling 36 that extends through the wall 14 is very small and difficult to grasp. In the exemplary embodiment, the tool engaging profile 55 comprises at least two elongate grooves 57 extending axially into the coupling 36. The grooves 57 are positioned on opposing surfaces of the coupling interior and are sized to receive the opposing exterior surfaces of a wrench or a purpose built tool. Similar grooves may additionally, or alternatively, be placed on the exterior of the coupling 36.

The coupling 36 is initially provided with a blind end 52 (see FIG. 3). The blind end 52 allows the closet carrier assembly 10 and the plumbing to and from the closet carrier assembly 10 to be pressure tested. As will be discussed in more detail below, the blind end 52 is cut off to create an open end 54. Removal of the blind end 52 also reveals the tool engaging profile 55 in the interior of the coupling 36. Because the tool engaging profile 55 extends inward into the coupling 36, the coupling 36 can be cut at various points along its length without cutting off the tool engaging profile 55. The open end 54 is inserted into the sealing groove 22 of the water closet 12 to sealingly seat in the deformable seal 26 and make a water tight passage between the faceplate 28 and the water closet 12.

As best seen in FIG. 2, the carrier body 30 has a carrier seal groove 56 that receives a carrier seal 58, for example a neoprene carrier gasket. The carrier seal 58 is adapted to abut and seal against the faceplate 28 (see FIG. 1) to produce a water tight seal between the faceplate 28 and the carrier body 30. The carrier seal groove 56 circumscribes a carrier flow port 60 that communicates fluid between the carrier body 30 and the faceplate 28. Carrier body 30 has a mounting flange 70 that receives multiple fasteners 72 (only one of which is shown) to affix the carrier body 30 to the faceplate 28.

The carrier body 30 has one or more waste flow ports 62 in communication with building waste plumbing 74 for communication of waste out of the carrier body 30. The carrier body 30 additionally has a vent port 64 for connection to the building vent plumbing 76.

An exemplary method of installing the closet carrier assembly 10 together with a water closet 12 in relation to a vertical wall 14 is discussed below. As would be apparent to one of ordinary skill in the art, various of the following method steps can be performed in differing orders or simultaneously, and the method of the invention is not intended to be limited to one specific order.

With the carrier seal 58 installed in the carrier seal groove 56 of the carrier body, the faceplate 28 is affixed to the carrier body 30 with fasteners 72. The carrier seal 58 forms a water tight seal between the carrier body 30 and the faceplate 28. Additionally, the supports 31 are affixed to the faceplate 28. The building waste plumbing 74 is connected to waste ports 62 of the carrier body 30 as is the building vent plumbing 76 connected to the carrier body vent port 64. The supports 31 are affixed to the floor 68, or other fixed object, to support the carrier body 30 in position.

The seal 44 is installed on the cylindrical coupling 36, and the coupling 36 is inserted through vertical wall 14 such that the blind end 52 resides on the side of the wall where the water closet 12 will later be installed. The coupling 36 is threaded into the cylindrical protrusion 32 until the seal 44 sealingly seats against the outward facing surface 48 or corresponding seal groove 50 of the cylindrical protrusion 32. If the internal threads 34 on the faceplate 28 and the external threads 38 on the coupling 36 are straight threads, as opposed to tapered threads, the coupling 36 can be threaded into the cylindrical protrusion 32 by hand. The coupling 36 need only be hand-tight for the seal 44 to form a water tight seal. A much higher tightening torque, achievable only with a wrench, must be applied to tapered threads if relying, as in the prior art, on the tapered threads to form a seal.

The coupling 36 is initially provided and installed with a blind end 52. The seal between the coupling 36 and building waste plumbing 74, the coupling 36 and the faceplate 28, and the faceplate 28 and the carrier body 30 can be tested by filling the closet carrier assembly 10 with fluid, and optionally pressurizing the fluid. Once it is determine there are no leaks, the required length of the coupling 36 is determined such that the coupling 36 extends outward from the vertical wall 14 enough to sealingly seat in the deformable seal 26 of the water closet 12 when the water closet is mounted to the vertical wall 14. The coupling 36 can be unthreaded from the faceplate 28, and cut to the desired length. Alternately, the coupling 36 can remain adjoined to the faceplate 28 and the coupling 36 cut to length. Removing the coupling 36 from the faceplate 28, however, has the advantage of allowing easier access to the coupling 36. For example, the coupling 36 can be removed and cut on a nearby workbench where there is no interference between the tool used to cut the coupling 36 and the wall, floor, or adjacent installations.

After being cut to length, coupling 36 has an open end 54 that allows flow of fluid therethrough. If the coupling 36 has been removed from the faceplate 28, it can be re-installed in the faceplate 28 and tightened to form a water tight seal. As noted above, if the internal threads 34 and the external threads 38 are straight threads, the seal 44 need only be hand tight against cylindrical protrusion 32 to form a seal. Furthermore, the flange member 40 of the coupling 36 in proximity to the cylindrical protrusion 32 both ensures that threading engagement between the coupling 36 and the faceplate 28 is enough to support the loads applied to the coupling 36, for example by the water closet 12 and the water closet's user, as well as indicate to the installer that the coupling 36 is properly installed. If provided with a tool engaging profile 55, a wrench or other tool can be used to engage the tool engaging profile 55 and further tighten the coupling 36.

The seal by seal 44 can be reliably and repeatably achieved throughout multiple removals and installations of the coupling 36. This is in contrast to prior art systems that rely solely on a seal formed by the tapered threads or by additional clamping or sealing mechanisms. In prior art systems using tapered threads, the seal made by the threads depends upon achieving a consistent thread interference that can vary each time the threaded connection is taken apart and made up. Additional, such consistent thread interference is achieved at a higher tightening torque than needed to achieve a seal with the coupling 36 of the present invention.

After coupling 36 is re-installed into the faceplate 28, the water closet 12 is placed against the vertical wall 14 such that the deformable seal 26 is pressed around the open end 54 of coupling 36 to seal the water closet 12 to coupling 36. Fasteners 20 are used to secure the water closet 12 to the closet carrier assembly 10, and support the water closet 12 in relation to the vertical wall 14 and the closet carrier assembly 10.

Although the present invention has been described in considerable detail with reference to certain preferred versions thereof, other versions are possible. Therefore, the spirit and scope of the appended claims should not be limited to the description of the preferred versions contained herein.

I claim:

1. A tubular coupling for connecting a closet carrier assembly to a water closet that communicates waste through a lateral port, the tubular coupling comprising:

a tubular body adapted to engage the closet carrier assembly and sized to extend between the closet carrier assembly and the water closet;

a deformable seal operable to seal the tubular body to the closet carrier assembly; and a groove having at least one side wall forming a tool engaging profile, the groove located on a surface of the tubular body and extending substantially parallel to a longitudinal axis of the tubular body.

2. The tubular coupling of claim 1, wherein the tubular body has a blind end.

3. The tubular coupling of claim 1, wherein the tubular coupling has a radially protruding flange thereon, the radially protruding flange adapted to abut the closet carrier assembly.

4. The tubular coupling of claim 3, wherein the deformable seal is adjacent to the radially protruding flange.

5. The tubular coupling of claim 4, wherein the deforniable seal is adapted to be compressed between the closet carrier assembly and the radially protruding flange to make a water tight seal.

6. The tubular coupling of claim 4, wherein the deformable seal is adapted to form a water tight seal between an outward facing surface of the closet carrier assembly and the radially protruding flange.

7. The tubular coupling of claim 1, wherein the closet carrier assembly comprises a carrier body assembly having at least one inlet for receiving waste and at least one outlet for communicating waste out of the carrier body assembly, wherein the at least one inlet has an outward facing surface substantially orthogonal to a longitudinal axis of the inlet.

8. The tubular coupling of claim 7, wherein the carrier body assembly has threads adapted to engage corresponding threads on the tubular coupling, and wherein the threads on at least one of the carrier body assembly and the tubular coupling have a constant major diameter.

9. The tubular coupling of claim 7, wherein the at least one inlet has internal threads therein and wherein the tubular coupling has external threads thereon.

10. The tubular coupling of claim 1, wherein the deformable seal is an elastomeric o-ring.

11. The tubular coupling of claim 1, wherein the at least one tool engaging profile is adapted to be accessible at various depths in the tubular coupling.

12. The tubular coupling of claim 1, further comprising a flange member having a seal receiving groove thereon, the seal receiving groove adapted to receive and retain the deformable seal.

13. The tubular coupling of claim 1, wherein the groove comprises at least two elongate grooves extending axially into the tubular coupling.

14. The tubular coupling of claim 13, wherein the at least two elongate grooves are positioned on opposing surfaces of an interior surface of the tubular coupling.

15. The tubular coupling of claim 1, wherein the at least one tool engaging profile is on an interior surface of the tubular body.

16. A tubular, coupling for connecting a closet carrier assembly to a water closet that communicates waste through a lateral port, the tubular coupling comprising:

a tubular body adapted to engage the closet carrier assembly and sized to extend between the closet carrier assembly and the water closet;

a deformable seal operable to seal the tubular body to the closet carrier assembly;

at least one tool engaging profile on a surface of the tubular body and extending substantially parallel to a longitudinal axis of the tubular body;

wherein the tubular body further comprises a carrier facing surface orthogonal to a longitudinal axis of the tubular body adapted to reside adjacent to an outward facing surface of the closet carrier assembly; and wherein the deforniable seal is operable to seal between the outward facing surface of the closet carrier assembly and the carrier facing surface of the tubular coupling.

17. A tubular coupling for connecting a closet carrier assembly to a water closet that communicates waste through a lateral port, the tubular coupling comprising:

a tubular body adapted to extend between the closet carrier assembly and the water closet, the tubular body further adapted to engage the closet carrier assembly; and a deformable seal adapted to be compressed between an outward facing surface of the closet carrier assembly and a carrier facing surface orthogonal to a longitudinal axis of the tubular body to seal the tubular body to the closet carrier assembly; and at least one tool engaging profile on a surface of the tubular body and extending substantially parallel to a longitudinal axis of the tubular body.

18. The tubular coupling of claim 17, wherein the at least one tool engaging profile is a groove extending substantially parallel to a longitudinal axis of the tubular body.

19. The tubular coupling of claim 17, wherein the at least one tool engaging profile is adapted to be accessible at various depths the tubular coupling.

20. The tubular coupling of claim 17, wherein the tubular coupling has a radially protruding flange thereon, the radially providing flange adapted to abut the closet carrier assembly.

21. The tubular coupling of claim 17, wherein the closet carrier assembly comprises a carrier body assembly having at least one inlet for receiving waste and at least one outlet for communicating waste out of the carrier body assembly, wherein the at least one inlet has an outward facing surface substantially orthogonal to a longitudinal axis of the inlet.

22. The tubular coupling of claim 21, wherein the carrier body assembly has threads adapted to engage corresponding threads on the tubular coupling.

23. The tubular coupling of claim 21, wherein the at least one inlet has internal threads therein and wherein the tubular coupling has external threads thereon.

24. The tubular coupling of claim 17, further comprising a flange member having a seal receiving groove thereon, the seal receiving groove adapted to receive and retain the deformable seal.

25. The tubular coupling of claim 17, wherein the at least one tool engaging profile is on an interior surface of the tubular body.

26. The tubular coupling of claim 17, wherein the tool engaging profiles part of a groove extending along the longitudinal axis of the tubular body.

27. A tubular coupling for connecting a closet carrier assembly to a water closet that communicates waste through a lateral port, the tubular coupling comprising:

a tubular body adapted to extend between the closet carrier assembly and the water closet, the tubular body further adapted to engage the closet carrier assembly and having a carrier facing surface orthogonal to a longitudinal axis of the tubular coupling that is adapted to reside adjacent an outward facing surface of the closet carrier assembly which is also orthogonal to the longitudinal axis; and a deformable seal compressed between the outward facing surface of the closet carrier assembly and the carrier facing surface of the tubular body to form a water tight seal between the closet carrier assembly and the tubular body.

28. The tubular coupling of claim 27, wherein the closet carrier assembly comprises a carrier body assembly having at least one inlet for receiving waste and at least one outlet for communicating waste out of the carrier body assembly, wherein the at least one inlet has an outward facing surface substantially orthogonal to a longitudinal axis of the inlet.

29. The tubular coupling of claim 28, wherein the carrier body assembly has threads adapted to engage corresponding threads on the tubular coupling.

30. The tubular coupling of claim 28, the at least one inlet has internal threads therein and wherein the tubular coupling has external threads thereon.

31. The tubular coupling of claim 27, wherein the deformable seal comprises an elastomeric o-ring.

32. The tubular coupling of claim 27, further comprising a tool engaging profile on an interior of the tubular body adapted to enable a tool to engage the interior of the tubular body.

33. The tubular coupling of claim 32, wherein the tool engaging profile s an elongated groove.

34. The tubular coupling of claim 32, wherein the tool engaging profile a ted to be accessible at various depths in the tubular body.

35. The tubular coupling of claim 27, wherein the tubular coupling has a blind end.

36. The tubular coupling of claim 27, wherein the tubular coupling further comprises a seal receiving groove adapted to receive and retain the deformable seal.

37. The tubular coupling of claim 27, wherein the carrier facing surface comprises the surface of a flange.

* * * * *